US005321987A

United States Patent [19]

Rometsch

[11] Patent Number: 5,321,987

[45] Date of Patent: Jun. 21, 1994

[54] CRANKING ARRANGEMENT WITH BRAKE DEVICE

[75] Inventor: Werner Rometsch, Gerlingen, Fed. Rep. of Germany

[73] Assignee: Robert Bosch GmbH, Stuttgart, Fed. Rep. of Germany

[21] Appl. No.: 852,125

[22] PCT Filed: Feb. 22, 1991

[86] PCT No.: PCT/DE91/00140

§ 371 Date: Apr. 27, 1992

§ 102(e) Date: Apr. 27, 1992

[87] PCT Pub. No.: WO91/14094

PCT Pub. Date: Sep. 19, 1991

[30] Foreign Application Priority Data

Mar. 3, 1990 [DE] Fed. Rep. of Germany ..... 4006797

[51] Int. Cl.[5] ..... F02N 15/06

[52] U.S. Cl. ..... 74/7 A; 74/7 E; 192/45

[58] Field of Search ..... 74/7 R, 7 A, 7 C, 7 E; 192/7, 12 R, 12 B, 15, 42, 45

[56] References Cited

U.S. PATENT DOCUMENTS

| | | | |
|---|---|---|---|
| 2,759,363 | 8/1956 | Lewis | 192/45 X |
| 2,777,328 | 1/1957 | Wagner | 74/7 E |
| 4,304,140 | 12/1981 | Ebihara | 192/45 X |
| 4,412,457 | 1/1983 | Colvin | 74/7 A |
| 4,635,489 | 1/1987 | Imamura et al. | 74/7 A X |

FOREIGN PATENT DOCUMENTS

| | | | |
|---|---|---|---|
| 1107059 | 12/1955 | France . | |
| 2536466 | 5/1984 | France . | |
| 1-247762 | 10/1989 | Japan | 74/7 E |

*Primary Examiner*—Leslie A. Braun
*Assistant Examiner*—David W. Laub
*Attorney, Agent, or Firm*—Michael J. Striker

[57] ABSTRACT

A cranking arrangement has a rotor, an output shaft driven by a rotor, a pinion carried by the output shaft for driving a toothed ring of an internal combustion engine, the output shaft being supported so that it can be displaced axially for engagement and disengagement of the pinion, and a brake surface. The output shaft acts upon the rotor in a disengaged position axially in such a way that the rotor meets the brake surface.

8 Claims, 2 Drawing Sheets

CRANKING ARRANGEMENT WITH BRAKE DEVICE

BACKGROUND OF THE INVENTION

The invention concerns a cranking arrangement with an output shaft driven by a rotor and carrying a pinion for driving a toothed ring of an internal combustion engine, the output shaft being supported so that it can be displaced axially for the engagement and disengagement of the pinion.

In motor vehicle technology, such cranking arrangements are used for starting the vehicle internal combustion engines. For the starting procedure of the vehicle internal combustion engines, a driven pinion must engage in a toothed ring of the internal combustion engine. An output shaft carrying the pinion is supported so that it can be displaced axially in order to provide the axial movement necessary for this purpose. When the starting procedure has been ended, the pinion disengages from the toothed ring, the output shaft returning to its initial position (disengaged position). After disengagement, it is disadvantageous for the pinion to continue to rotate for a relatively long time because then, in the event of a possible restart procedure, the engagement is not clean and damage may result due to a large relative motion between the pinion and the toothed ring. The run-down time is particularly long in the case of geared cranking arrangements—compared with direct cranking arrangements (without gear stage) - because the moments of inertia increase with the square of the transmission ratio.

SUMMARY OF THE INVENTION

Accordingly, it is an object of the present invention to provide a cranking arrangement which avoids the disadvantages of the prior art.

In keeping with these objects and with others which will become apparent hereinafter, one feature of the present invention resides, briefly stated, in a cranking arrangement of this type in which the output shaft acts upon the rotor in the disengaged position axially in such a way that the rotor meets a brake surface.

When the cranking arrangement is designed in accordance with the present invention as specified hereinabove, it has, in contrast, the advantage that long pinion run-down times at the end of the starting procedure are prevented. In accordance with the invention, a braking effect is automatically initiated by the output shaft returning into the disengaged position and this-braking effect retards the drive rotor and therefore the pinion also. The teaching in accordance with the invention proposes, for this purpose, that the return motion of the output shaft should be transmitted to the rotor in such a way that the latter is similarly axially displaced and therefore comes against the brake surface. Such braking is particularly effective in the case of geared cranking arrangements because the rotor represents an element which is associated with a relatively small torque. In consequence, even relatively small brake forces lead to a large effect.

An extension of the invention provides for the output shaft meeting a sprung contact element of the rotor. This sprung support between the output shaft and the rotor on the one hand compensates for tolerances but still causes transmission of axial forces to the rotor.

It is advantageous for the contact element to be located coaxially with the rotor. This avoids unbalance and also achieves smaller moments of inertia.

In order to maintain the sprung effect of the contact element, a compression spring is preferably located between the contact element and the rotor.

A construction which is particularly economical in space, but is nevertheless simple, is obtained when the contact element is guided so that it can be displaced axially in an axial hole of a rotor shaft. The contact element can, in particular, be designed as the starting pin. The latter preferably has a circular cross-section, its central axis extending coaxially with the rotor axis.

A good braking effect can be achieved when the brake surface is formed on a brake disc. The latter is preferably located between the end of a commutator associated with the rotor and a casing region of the cranking arrangement.

Provision is made, in particular, for the casing region to-be formed by a contact surface surrounding a rotor bearing.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF AN PREFERRED EMBODIMENT

Figure 1:
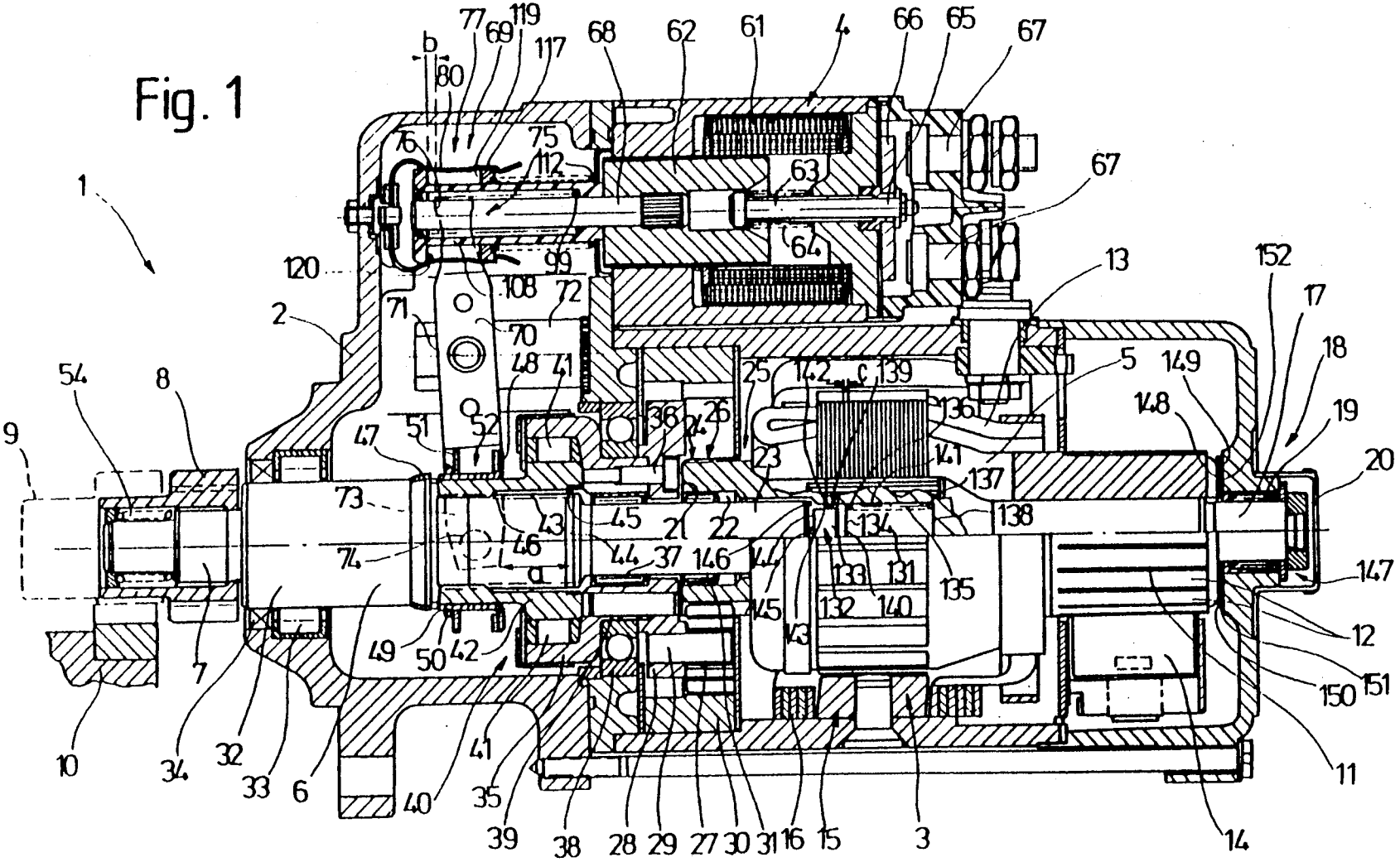
FIG. 1 shows a longitudinal section through a cranking arrangement.

FIG. 1 shows a longitudinal section through a cranking arrangement 1. This has a casing 2 in which are accommodated a direct current motor 3 and an engagement relay 4. The direct current motor 3 has a rotor 5 which acts on an output shaft 6 and a pinion 8 is arranged to be torsionally fixed on the end 7 of the output shaft 6. For the starting of an internal combustion engine (not shown), the pinion 8 moves forward into the position 9 shown dotted in FIG. 1 and, in the process, engages in a toothed ring 10 of the internal combustion engine. The axial displacement of the pinion into the position 9 is initiated by the engagement relay 4. This is considered in more detail below.

The rotor 5 is provided with a commutator 11, to whose segments 12 is connected a rotor winding 13. The commutator 11 interacts with a carbon brush arrangement 14. Also provided is a stator 15 which has a stator winding 16 and faces the rotor 5 across a small air gap.

The rotor 5 has a rotor shaft 17 which is supported at one of its ends 18 in a needle bearing 19 and is covered by a casing cap 20. The other end of the rotor shaft 17 has a central acceptance hole 22 starting from its end face 21, the end 23 of the output shaft 6 engaging in this acceptance hole. The other end of the rotor shaft 17 is supported on the end 23 of the output shaft 6 by means of a needle bearing 31 which is located in the acceptance hole 22. The outer surface 24 of the rotor shaft end 25 provided with the acceptance hole 22 is designed as the sun wheel 26 which engages with planet wheels 27 which are located on a planet carrier 28 (only one planet wheel 27 is shown in FIG. 1). The planet wheels 27 are located by means of needle bearings on bearing pins 29.

In addition, the planet wheels 27 engage with an internal gear wheel 30, provided with inner teeth, permanently located in the casing 2.

The end 23 of the output shaft 6 is supported by means of a needle bearing 37 in the acceptance hole of the axial protrusion 39. The freewheel outer ring 35 is held by a deep groove ball bearing 38 which is located on the axial protrusion 39 and is also supported in the casing 2 (fixed bearing). In the opposite end region 32 of the output shaft 6, a cylindrical roller bearing 33—held by the casing 2—is provided and fitted in front of it—towards the outside—there is a shaft seal 34. The cylindrical roller bearing 33 guides the output shaft 6 in both the axial and radial direction.

The planet carrier 28 is axially connected to a freewheel outer ring 35 by means of screws 36.

The freewheel outer ring 35 is part of a freewheel device 40 which is designed as a roller freewheel. It has spring-loaded rollers 41 which interact with an inner ring 42 of the freewheel device 40. The inner ring 42 is in connection with the output shaft 6 via a steep thread 43. In addition, the output shaft 6 has a groove 44 in which is located a spring ring 45. The spring ring 45 forms a stop which interacts with a step 46 of the inner ring 42 in the case of an axial displacement of the output shaft 6—still to be described in more detail.

A retention ring 47 which has a radial collar 48, is fastened on the output shaft 6. In addition, a spring ring 50, located in a groove 49 of the retention ring 47, supports a washer 51. There is, therefore, an annular channel 52 formed between the washer 51 and the radial collar 48.

The pinion 8 is supported, torsionally fixed but axially displaceable on the end 7 of the output shaft 6. It is subjected to an action of a helical compression spring 54. This is preloaded when the pinion 8 engages with a tooth-on-tooth position in the toothed ring 10.

The engagement relay 4 has a fixed relay winding 61 which interacts with an armature 62. The armature 62 is supported so that it can be displaced axially and it is forced, in the non-excited condition of the engagement relay 4, by a return spring 112 designed as a helical compression spring into the position shown in FIG. 1. On its end region 65, the pin 63 has a contact element 66 which can interact with electrical connections 67.

The armature 62 is connected to a rain 68 which protrudes into a casing space 69 of the casing 2. The ram 68 interacts with an engagement lever 70, which is designed as a double lever and is pivotably supported approximately in its central area by means of a transverse pin 71. The transverse pin 71 is held on a casing extension arm 72. The lower end 73 of the engagement lever 70 is provided with a projecting part 74 which engages in the annular channel 52. A drive head 76 is formed on the other end 75 of the engagement lever 70. The engagement lever 70 is driven by displacement of the ram 68 so that an axial displacement of the output shaft 6 takes place. In the non-excited condition of the engagement relay 4, arrangements have to be made to ensure that the pinion 8 does not leave the position shown with full lines in FIG. 1. A locking device 77, formed essentially by a stirrup spring 80, a control sleeve 108, a ring 117 and springs 99 and 112, prevents the pinion 8 from moving unintentionally in the direction of the toothed ring 10 of the internal combustion engine because this could lead to damage to the parts. This unintended axial motion could occur, in the absence of the locking device 77, by braking torques, which arise for example due to the bearings and shaft sealing rings, moving the output shaft 6 into the engaged position, i.e. the return spring forces are smaller than the axial force components arising at the steep thread.

It may be seen from FIG. 1 that the drive head 76 does not completely fill the gap between one side 119 of the ring 117 and an end surface 120 of the control collar 108; in fact, a distance b remains free.

The steep thread 43 permits an axial displacement of the output shaft 6 by the dimension a.

The acceptance hole 22 in the rotor shaft 17 of the rotor 5 ends in an axial hole 131 in which is located a sprung contact element 132. The contact element 132 is designed as the starting pin 133. The latter has a circular cross-section which is dimensioned relative to the diameter of the axial hole 131 in such a way that the starting pin 133 is guided in the axial hole 131 so that it can be axially displaced. The end 134, of the starting pin 133, facing away from the output shaft 6 is subjected to a compression spring 135 designed as a helical spring, i.e. one end 136 of the compression spring 135 is supported on the starting pin 133 and the other end 137 of the compression spring 135 is located at the bottom 138 of the axial hole 131 designed as a blind hole.

The outer surface 139 of the starting pin 133 has a radial collar 140 in the support region of the compression spring 135. Because of this, the other region of the outer surface 139 faces the internal wall 141 of the axial hole 131 across a gap. The gap is dimensioned in precisely such a way that a spring ring 143 can be accepted there, this spring ring 143 being inserted in an annular groove 142 formed in the inner wall 141. The spring ring 143 forms a stop for the starting pin 133. This means that when the starting pin 133 is not acted upon, the spring ring 143 limits the axial motion of the starting pin 133 caused by the compression spring 135.

The end 144 of the starting pin 133 facing towards the output shaft 6 has a central starting elevation 145. The arrangement is designed in such a way that, in the disengaged position of the output shaft 6 shown in FIG. 1, the end face 146 of the output shaft 6 acts on the starting elevation 145 of the starting pin 133 in such a way that the latter is moved away from the spring ring 143 by a displacement distance c. By this means, the compression spring 135 is correspondingly compressed so that a reaction force acts on the rotor 5 of the direct current motor 3. The displacement distance c is approximately 2 to 3 mm.

At the commutator end 18, the rotor shaft 17 is guided in a rotor bearing 147 which is designed as a needle bearing 19. A brake disc 151 provided with a brake surface 150 is located between the end face 148 of the rotor 5 or of the commutator 11 and a casing region 149 of the cranking arrangement 1. The casing region 149 is formed by a contact surface 152 surrounding the rotor bearing 147.

The cranking arrangement 1 in accordance with the invention operates as follows:

For a starting procedure of the internal combustion engine (not shown), the engagement relay 4 is excited by means of a starting switch. This has the effect that the armature 62 moves towards the right (FIG. 1) so that the control sleeve 108 runs against the stirrup spring 80 in such a way that the latter is spread out radially. This releases the ring 117. A relative motion between the control sleeve 108 and the ring 117, using up the free distance b, is possible because the ring 117 is supported on the control sleeve 108 so as to be axially displaceable. If the stirrup spring 80 takes up its spread position, the free distance b is used up, i.e. the left-hand side of the drive head 76 is driven by the control sleeve 108. The engagement lever 70 executes a pivoting motion in the clockwise direction around the transverse pin 71. The projecting part 74 then displaces the output shaft in the direction of the toothed ring 10 so that the pinion 8 can engage in the teeth of the toothed ring 10. The engagement forces ensure that the pinion 8 now moves completely into the toothed ring 10, the output shaft 6 moving out axially into the end position because of the steep thread 43 so that—as a result—the position 9, shown by dotted lines in FIG. 1, is taken up by the pinion 8. Because the contact element 66 makes connection with the electrical connection 67 due to the attraction motion of the engagement relay 4, the direct current motor 3 is excited, which means that the rotor 5 begins to rotate, so that the pinion 8 is driven along with it by means of the transmission gear formed from the sun wheel 26, the planet wheels 27 and the internal gear wheel 30.

If the starting procedure has ended, the engagement relay 4 drops out. The dropping-out motion is supported by the return springs 64 and 112. The ring 117 then meets the drive head 76 of the engagement lever 70 so that the engagement lever 70 pivots anticlockwise, which returns the pinion 8 to the position shown by a full line in FIG. 1. Because, in the final stage of the starting procedure, the internal combustion engine—which is now operating—"overtakes" the rotation of the pinion 8, the disengagement procedure is supported by the steep thread 43.

If the disengaged position (rest position) has been resumed (FIG. 1), the stirrup spring 80 has also returned to the initial position, which means that it secures the ring 117 so that the engagement lever 70 is fixed in the position shown in FIG. 1. This prevents an unintentional axial displacement of the output shaft 6.

Figure 2:
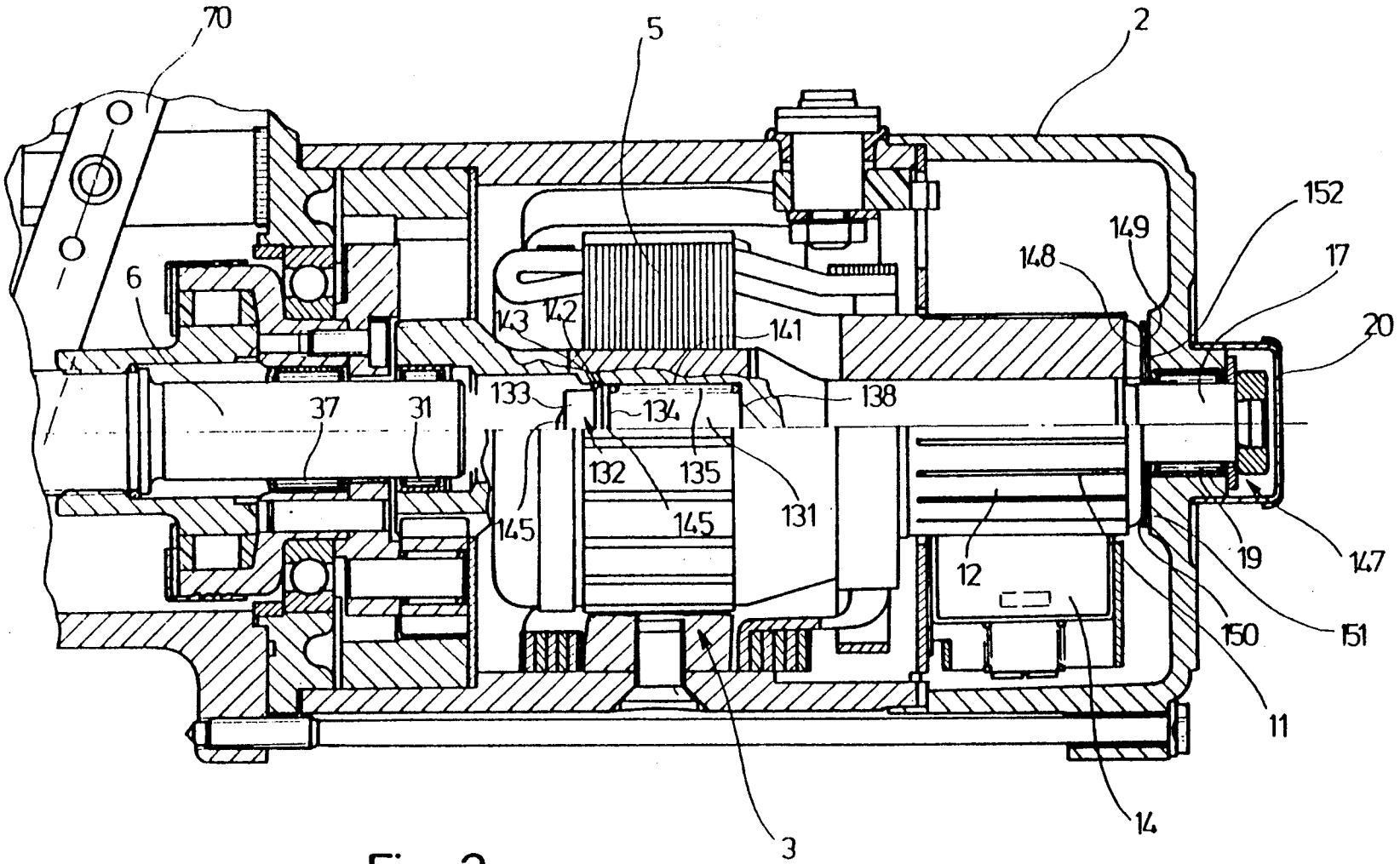
FIG. 2 shows a detail from the representation of FIG. 1, an engaged position being assumed.

If—as described—the output shaft 6 is displaced, for the starting procedure of the internal combustion engine, into its engaged position as shown in FIG. 2, the end face 146 of the output shaft 6 removes the load from the starting pin 133 so that its radial collar 140 is forced against the spring ring 143 by the compression spring 135. The rotor 5 of the direct current motor 3 is therefore no longer subject to any axial force caused by the starting pin. If the starting procedure has ended, the output shaft 6 returns to its disengaged position, shown in FIG. 1, so that the end face 146 forces the starting pin 133 back into the position shown in FIG. 1, the compression spring 135 being compressed in the process. By this means, a reaction force is exerted on the rotor 5 so that the end face 148 of the commutator 11 is forced against the brake disc 151. The brake disc 151 is in turn supported on the contact surface 152 of the casing 2. This subjects the rotational motion of the rotor 5 to a braking action. This braking procedure is particularly effective in the case of the geared cranking arrangement shown because it takes place at a location which is associated with a relatively low torque. The result is a very short run-down time for the cranking arrangement.

It will be understood that each of the elements described above, or two or more together, may also find a useful application in other types of constructions differing from the types described above.

While the invention has been illustrated and described as embodied in a cranking arrangement with brake device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters Patent is set forth in the appended claims.

1. A cranking arrangement, comprising a rotor; an output shaft driven by said rotor; a pinion carried by said output shaft for driving a toothed ring of an internal combustion engine, said output shaft being supported so that it can be displaced axially for engagement with and disengagement of said pinion with said toothed ring; a brake surface, said output shaft acting upon said rotor in a disengaged position axially in such a way that said rotor abuts against said brake surface, said rotor having a sprung contact element, said output shaft abutting against said spring contact element of said rotor.

2. A cranking arrangement as defined in claim 1, wherein said springs contact element is located coaxially with said rotor.

3. A cranking arrangement as defined in claim 1; and further comprising a compression spring located between said spring contact element and said rotor.

4. A cranking arrangement as defined in claim 1, wherein said rotor has a rotor shaft provided with an axial hole, said spring contact element being provided so as to be axially displaceable in said axial hole of said rotor shaft.

5. A cranking arrangement as defined in claim 1, wherein said contact element is formed as a starting pin.

6. A cranking arrangement as defined in claim 1, wherein said brake surface is formed as a brake disc.

7. A cranking arrangement as defined in claim 6; and further comprising a casing having region; and a commutator associated with said rotor and having an end face, said brake ring being located between said end face of said commutator and said casing region.

8. A cranking arrangement as defined in claim 7; and further comprising a rotor bearing, said casing region being formed as a contact surface surrounding said rotor bearing.

* * * * *